US007934900B1

(12) United States Patent
Pask

(10) Patent No.: US 7,934,900 B1
(45) Date of Patent: May 3, 2011

(54) NOZZLE GUIDE VANE FOR A GAS TURBINE ENGINE

(75) Inventor: George Pask, Stanton-by-Bridge (GB)

(73) Assignee: Rolls-Royce Limited, London (GB)

( * ) Notice: Subject to any disclaimer, the term of this patent is extended or adjusted under 35 U.S.C. 154(b) by 0 days.

(21) Appl. No.: 05/928,975

(22) Filed: Jul. 28, 1978

(30) Foreign Application Priority Data

Aug. 3, 1977 (GB) ..... 32480/77

(51) Int. Cl.
*F03B 11/00* (2006.01)

(52) U.S. Cl. ..... 415/115; 415/170.1

(58) Field of Classification Search ..... 415/170 R, 415/200, 212 A, 214
See application file for complete search history.

(56) References Cited

U.S. PATENT DOCUMENTS 3,301,526 A * 1/1967 Chamberlain ..... 415/214
3,857,649 A * 12/1974 Schaller et al. ..... 415/200

* cited by examiner

*Primary Examiner* — Christopher P Ellis
(74) *Attorney, Agent, or Firm* — Oliff & Berridge, PLC

(57) ABSTRACT

A nozzle guide vane for a gas turbine engine comprises a hollow ceramic vane member which includes an aerofoil portion and ceramic platforms. The ceramic vane member is supported by engagement of its interior surface with external supporting surfaces on a metallic load-bearing spine adapted to be supported from fixed structure of the engine.

10 Claims, 1 Drawing Sheet

NOZZLE GUIDE VANE FOR A GAS TURBINE ENGINE

This invention relates to a nozzle guide vane for a gas turbine engine.

Nozzle guide vanes in gas turbine engines are amongst the components which have to operate in a very hot environment, and there has been constant activity by engineers in attempting to provide sophisticated cooling systems for vanes or to improve the temperatures which the materials making up the vane can stand. Materials improvements have, in the past, mainly produced improved nickel or cobalt based alloys which have provided a considerable improvement, but it has been realised for some while that a step improvement in temperature capability could be achieved by the use of ceramic materials such as silicon nitride.

Unfortunately these materials are very brittle and it has been difficult to devise a practical way of mounting a vane. Even when the aerofoil portion of the vane is made of ceramic there still remains the difficulty of the platforms which are subject to almost as high temperatures as the aerofoil.

The present invention relates to a vane all of whose gas contacting surfaces are made of a ceramic material.

According to the present invention a nozzle guide vane for a gas turbine engine comprises a load bearing metallic spine member adapted to be supported from fixed structure of the engine and having external supporting surface, and a hollow ceramic vane member having internal surfaces which engage with the external supporting surfaces of the vane member, the ceramic vane member comprising a ceramic aerofoil portion and ceramic platforms at the ends of the aerofoil adapted to define the inner and outer boundaries of gas flow past the vane.

The ceramic vane member may be made as a plurality of separate abutting sections, thus these sections may be divided along chordwise planes of the aerofoil.

Preferably the load bearing spine is adapted to be detachably mounted from the fixed structure of the engine.

The invention also comprises a gas turbine engine having vanes as set out above.

Figure 1:
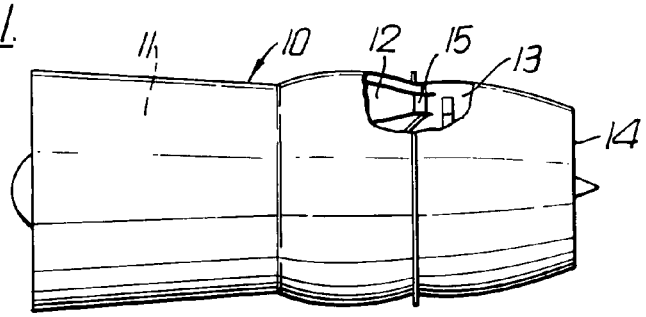
Figure 2:
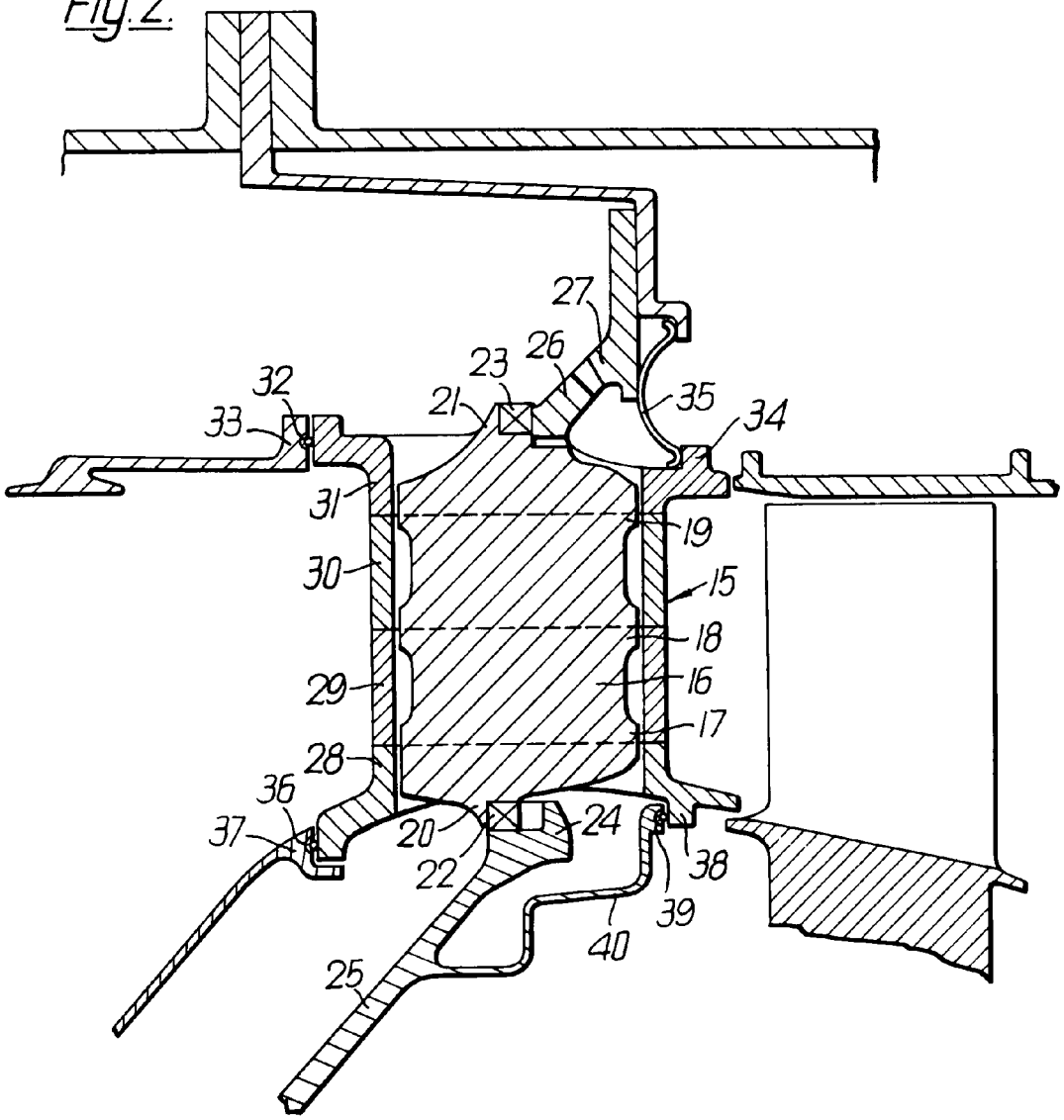

The invention will now be particularly described merely by way of example with reference to the accompanying drawings in which:

FIG. 1 is a partly broken away view of a gas turbine engine having nozzle guide vanes in accordance with the invention, and FIG. 2 is an enlarged section through the nozzle guide vane and associated structure of FIG. 1.

In FIG. 1, there is shown a gas turbine engine which is basically conventional in design. It comprises a casing 10 within which are located in flow series a compressor 11, combustion section 12 and turbine 13. At its downstream extremity the casing 10 terminates in a final nozzle 14. Operation of the engine as so far described is conventional in that the engine takes in air which is compressed by the compressor 11. The compressed air is mixed with fuel and burnt in the combustion section 12 and the hot gases thus produced are directed by nozzle guide vanes 15 onto the rotor of the turbine 13, driving the turbine and thus the compressor. The hot gases then exhaust through the nozzle 14 to provide propulsive thrust.

Because the guide vanes 15 take the initial impact of the hot gases from the combustion chamber 12 they are subject to very high temperatures and the vanes of the present invention are made of a ceramic material as can be seen in more detail in FIG. 2.

In FIG. 2 it will be seen that the nozzle guide vane indicated generally at 15 comprises a load bearing spine 16 which is made of a nickel based superalloy and which is of approximately aerofoil section. The spine 16 is provided with three flanges 17, 18 and 19 which extend from its surface adjacent its inner extent, its centre and its outer extent respectively. At its ends the spine 16 has supporting extensions 20 and 21 which are provided with dogged engagements at 22 and 23 by which the spine is supported from fixed structure of the engine. In the case of the inner extension 20, the dogs 22 engage with corresponding dogs on the rim 24 of a frustoconical support member 25, while in the case of the outer extension 21 the dogs 23 engage with corresponding features on forwardly extending fingers 26 forming part of a support flange 27.

The actual gas contacting part of the aerofoil and of the platforms is made up of a ceramic material and it will be seen that the dimensions of the hollow interior of the ceramic skin and of the flanges 17, 18 and 19 are chosen to be a fit so that the spine can support the ceramic skin.

In detail the ceramic skin comprises an inner portion 28 which includes the inner platform of the vane and a stub portion of the aerofoil, two aerofoil portions 29 and 30 which form the majority of the aerofoil and an outer portion 31 which again comprises the outer platform and a stub portion of the aerofoil. It will be seen that the abutments between these separate portions which lie in chordwise extending planes are arranged to fall on the middle of one of the flanges 17, 18 and 19. In this way each section is supported on both inner and outer extremities with the exception of the inner and outer sections 28 and 31. These sections are supported by the rim 24 and the fingers 26, the radial clearance of these features being carefully controlled to provide a gentle nip at running conditions. The sections 28 and 31 also sealingly engage with other structure of the engine, and they are supported by this engagement. In the case of the section 31 sealing takes place at its forward edge through a sealing ring 32 against the downstream end 33 of the combustion chamber, while adjacent downstream edge it has a projection 34 which is engaged by a spring 35 which contacts the flange 27.

In the case of the section 28 its forward edge again seals through a wire 36 against an inner portion 37 of the combustion chamber while at its downstream edge a projection 38 seals through a wire 39 with a projection 40 from the frustoconical member 25.

It will be seen that this construction provides a number of advantages. The gas load is taken out of the vane in a way which ensures minimum bending and very low peak stresses. The high stress paths are carried by the metal core. The vane comprising the ceramic skin and its supporting spine may be treated as a normal vane and may be removed and replaced separately from the other vanes, just as if they were conventional metal vanes. Also because the platforms of the vane as well as the aerofoil are made of ceramic there are no problems of differential expansion between these components or of the platforms melting and oxidising. Likewise the structure is maintained at a reasonably uniform and predictable temperature.

It will be understood that various modifications could be made to the described embodiment. Thus the ceramic skin could be made in more or less sections as desired, and the mounting means for the spine could differ from that described. The ceramic used for the skin could comprise silicon nitride or one of the alternative heat resistant materials.

I claim:

1. A nozzle guide vane for a gas turbine engine comprising:

a load bearing metallic spine member adapted to be supported from fixed structure of the engine and having external supporting surfaces; and a hollow ceramic vane member made up of a plurality of separate abutting sections, said hollow ceramic vane member having internal surfaces which engage with the external supporting surfaces of said spine member only in a vicinity of the divisions between the sections, said ceramic vane member further comprising a ceramic aerofoil portion and ceramic platforms at the ends of the aerofoil portion adapted to define inner and outer boundaries of the gas flow past the vane.

2. A nozzle guide vane as claimed in claim 1 and in which the abutting sections are divided from one another along chordwise planes of the aerofoil.

3. A nozzle guide vane as claimed in claim 1 and in which said load bearing spine is detachably mounted from the fixed structure of the engine.

4. A nozzle guide vane as claimed in claim 3 and in which said load bearing spine is provided with dogs at its extremities adapted to engage with corresponding dogs in the fixed structure of the engine.

5. A nozzle guide vane as claimed in claim 4 and in which said fixed structure comprises end abutments which abut with the ends of the ceramic vane structure to limit the lengthwise motion of said ceramic vane structure along said spine.

6. A nozzle guide vane as claimed in claim 1 and in which the ceramic platforms are sealed to adjacent fixed structure of the engine.

7. A nozzle guide vane as claimed in claim 6 and in which at least some of said seals comprise sealing wires held between opposed faces of said platforms and said fixed structure.

8. A nozzle guide vane for a gas turbine engine comprising:

a load bearing metallic spine member detachably mounted from fixed structure of the engine and having external supporting surfaces, said load bearing spine member being provided with dogs at its extremities adapted to engage with corresponding dogs in the fixed structure of the engine; and a hollow ceramic vane member having internal surfaces which engage with the external supporting surfaces of said spine member, said ceramic vane member comprising a ceramic aerofoil portion and ceramic platforms at the ends of the aerofoil portion adapted to define the inner and outer boundaries of the gas flow past the vane.

9. A nozzle guide vane as claimed in claim 8 and in which said fixed structure comprises end abutments which abut with the ends of the ceramic vane structure to limit the lengthwise motion of said ceramic vane structure along said spine.

10. A nozzle guide vane for a gas turbine engine comprising:

a load bearing metallic spine member adapted to be supported from fixed structure of the engine and having external supporting surfaces;

a hollow ceramic vane member having internal surfaces which engage with the external surfaces of said spine member, the ceramic vane member comprising a ceramic aerofoil portion and ceramic platforms at the ends of the aerofoil portion adapted to define the inner and outer boundaries of the gas flow past the vane; and sealing means between said ceramic platforms of said vane member and adjacent fixed structure of the engine, said sealing means comprising at least some seals of sealing wires held between opposed surfaces of said ceramic platforms and said fixed sturcture.

* * * * *